US008139993B2

(12) United States Patent
Thayer

(10) Patent No.: US 8,139,993 B2
(45) Date of Patent: Mar. 20, 2012

(54) WEB CLEANING SYSTEMS INCLUDING AN ELECTROSTATIC CLEANING BRUSH AND METHODS OF CLEANING PRINTED WEBS

(75) Inventor: Bruce Earl Thayer, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/768,889

(22) Filed: Apr. 28, 2010

(65) Prior Publication Data

US 2011/0268483 A1 Nov. 3, 2011

(51) Int. Cl.
*G03G 21/00* (2006.01)

(52) U.S. Cl. ..... 399/353; 399/34; 399/123

(58) Field of Classification Search ..... 399/353
See application file for complete search history.

(56) References Cited

U.S. PATENT DOCUMENTS 4,690,268 A * 9/1987 Ueshin ..... 198/399
5,416,572 A * 5/1995 Kolb et al. ..... 399/350
5,655,204 A 8/1997 Siegel
5,701,572 A 12/1997 Behe et al.
7,418,218 B2 8/2008 Thayer
2009/0067896 A1 * 3/2009 Katayama ..... 399/313
2009/0297195 A1 12/2009 Ferencz, Jr.

OTHER PUBLICATIONS

Anthony S. Condello; Fusers, Printing Apparatuses and Methods of Fusing Toner on Media; U.S. Appl. No. 12/262,540, filed Oct. 31, 2008.

* cited by examiner

*Primary Examiner* — David Gray
*Assistant Examiner* — Roy Y Yi
(74) *Attorney, Agent, or Firm* — Ronald E. Prass, Jr.; Prass LLP

(57) ABSTRACT

Web cleaning systems, apparatuses useful in printing onto webs, and methods of cleaning webs are provided. An exemplary embodiment of the web cleaning systems includes a first web cleaning device having a rotatable first electrostatic cleaning brush for contacting a first surface of a moving web on which toner is disposed to remove un-fixed toner from the first surface; and a first brush cleaning device having a first cleaning member contacting the first electrostatic cleaning brush for removing toner from the first electrostatic cleaning brush.

19 Claims, 4 Drawing Sheets

WEB CLEANING SYSTEMS INCLUDING AN ELECTROSTATIC CLEANING BRUSH AND METHODS OF CLEANING PRINTED WEBS

BACKGROUND

In printing, toner can be fixed to a web by heating the toner. Higher-mass toner images can be adequately fixed to the web by this heating, while low-density background toner may not be adequately fixed. As a result of this inadequate fixing of some toner to the web, when prints exit the printing apparatus and are cut to size and run through finishing stations, the un-fixed toner on the prints will tend to transfer to the finishing equipment and other prints.

It would be desirable to provide web cleaning systems, apparatuses useful in printing onto webs, and methods of cleaning printed webs that can effectively remove un-fixed toner from webs.

SUMMARY

Web cleaning systems, apparatuses useful in printing onto webs, and methods of cleaning printed webs are provided. An exemplary embodiment of the web cleaning systems comprises a first web cleaning device comprising a rotatable first electrostatic cleaning brush for contacting a first surface of a moving web on which toner is disposed to remove un-fixed toner from the first surface; and a first brush cleaning device including a first cleaning member contacting the first electrostatic cleaning brush for removing toner from the first electrostatic cleaning brush.

DRAWINGS

DETAILED DESCRIPTION

Figure 1:
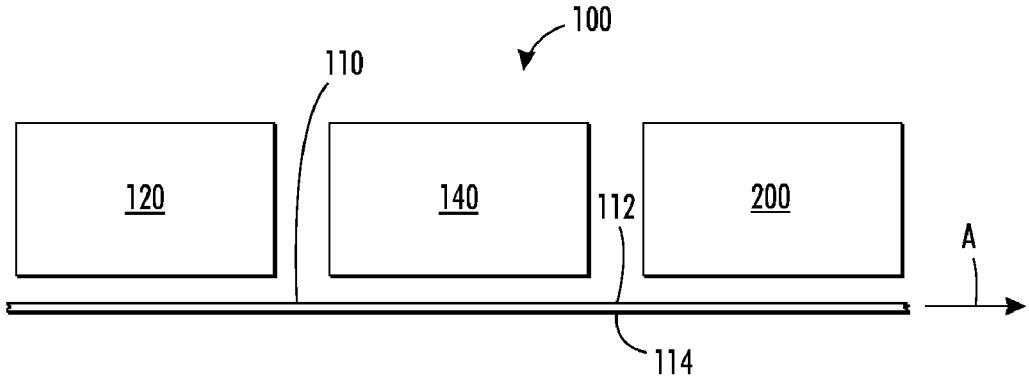
FIG. 1 depicts an exemplary embodiment of an apparatus including a web cleaning system.

The disclosed embodiments include web cleaning systems. An exemplary embodiment of the web cleaning systems comprises a first web cleaning device comprising a rotatable first electrostatic cleaning brush for contacting a first surface of a moving web on which toner is disposed to remove un-fixed toner from the first surface; and a first brush cleaning device including a first cleaning member contacting the first electrostatic cleaning brush for removing toner from the first electrostatic cleaning brush.

The disclosed embodiments further include apparatuses useful in printing onto webs. An exemplary embodiment of the apparatuses comprises a first marking device for applying toner onto a first surface of a web; a first fixing device for fixing the applied toner onto the first surface of the web; and a first web cleaning system downstream from the first fixing device. The first web cleaning system comprises a first web cleaning device including a rotatable first electrostatic cleaning brush for contacting the first surface of the web moving in the apparatus to remove un-fixed toner from the first surface; and a first brush cleaning device including a first cleaning member contacting the first electrostatic cleaning brush for removing toner from the first electrostatic cleaning brush.

The disclosed embodiments further include methods of cleaning printed webs. An exemplary embodiment of the methods comprises contacting a first surface of a moving web on which toner is disposed with a rotating first electrostatic cleaning brush of a first web cleaning device to remove un-fixed toner from the first surface; and contacting the first electrostatic cleaning brush with a first cleaning member of a first brush cleaning device to remove toner from the first electrostatic cleaning brush.

It has been noted that certain web cleaning devices do not adequately remove un-fixed toner from webs. For example, while paper web cleaning devices that are designed to remove fibers and dust on paper webs, as the webs are fed from rolls into printing presses or other apparatuses requiring a clean paper input, can remove un-fixed toner from webs, these devices can cause other problems when used for this purpose. For example, paper web cleaning devices that include mechanical brushes can overly aggressively contact the paper and cause damage to images. Furthermore, the brushes in some paper web cleaners may become contaminated with toner after only limited operation due to electrostatic matching of the brush materials and the toner particles to be cleaned. When this problem occurs, in order to prevent toner contained in the cleaning brushes from smearing on prints, the printing apparatus needs to be repeatedly shut down to clean the brushes, which reduces productivity.

In view of these problems, web cleaning systems are provided that can clean printed webs to remove objectionable, un-fixed toner without damaging fixed images on the webs, or the web surfaces. The web cleaning systems also can provide effective web cleaning for extended periods of operation without needing service for cleaning. Embodiments of the web cleaning systems include at least one electrostatic cleaning brush for cleaning un-fixed toner from printed webs. The electrostatic cleaning brushes have desirable low impact on the web surface and on fixed images during web cleaning.

FIG. 1 depicts an exemplary apparatus 100 including a marking device 120, a fixing device 140 and a web cleaning system 200 arranged in this order. A web 110 is shown moving in the process direction A in the printing apparatus 100. The marking device 120 applies toner to the web 110 to form toner images, the fixing device 140 fixes the toner images on the web 110, and the web cleaning system 200 removes unfixed toner from the web 110.

The marking device 120 can have any suitable configuration. For example, the marking device 120 can be constructed to apply toner directly to the web to form images, such as by using a roll to which the toner is applied. Alternatively, the marking device 120 can be constructed to apply toner to an intermediate member, such as a roll or belt, and then to transfer the toner images from the intermediate member to the web. In embodiments, depending on the construction of the marking device 120, toner can be applied to only the top surface 112 of the web 110 for a simplex printed web, or to both the top surface 112 and the bottom surface 114 for a duplex printed web.

The web 110 is comprised of a dielectric material (i.e., an electrical insulator) on which toner images can be formed. In embodiments, the web 110 can be comprised of plain paper; coated paper; at least one polymer, such as plastic; packaging material, or the like.

The fixing device 140 can be any suitable non-contact or contact fixing device for fixing toner onto the web 110. Exemplary non-contact-type fixing devices can heat the toner applied to the web 110 using radiant energy to fix the toner to the web 110. For example, the non-contact fixing devices can include one or more radiant energy sources, such as flash lamps, or the like. Exemplary fixing devices that include a radiant energy source to fix toner on substrates are described in U.S. Patent Application Publication No. 2009/0297195, which is incorporated herein by reference in its entirety. Other non-contact fixing devices can apply thermal energy to the toner on the web 110 using a hot gas, such as steam. Exemplary fixing devices that fix toner on substrates using a hot gas are described in U.S. patent application Ser. No. 12/262,540, which is incorporated herein by reference in its entirety.

Contact-type fixing devices that can be used for the fixing device 140 include opposed fixing members that form a nip. As the web 110 is moved through the nip, the fixing members can apply heat and pressure to the web 110 to fix the toner to the web 110. In the contact-type fixing devices, the fixing members can include two rolls (e.g., a fuser roll and a pressure roll); a roll and a belt (e.g., a pressure roll and a fuser belt); or two belts. In these fixing devices, at least one of the fixing members is internally and/or externally heated to supply thermal energy to the web 110.

In normal operation of the printing apparatus 100, some of the toner that is applied to the web 110 by the marking device 120 may not be adequately fixed to the web 110 by passing it through the fixing device 140 and subjecting the toner to heating alone, or to a combination of heating and applied pressure. The web cleaning system 200 is provided in the printing apparatus 100 to remove such un-fixed toner from the top surface 112 and/or the bottom surface 114 of the web 110 after the web 110 is passed through the fixing device 140.

Figure 2:
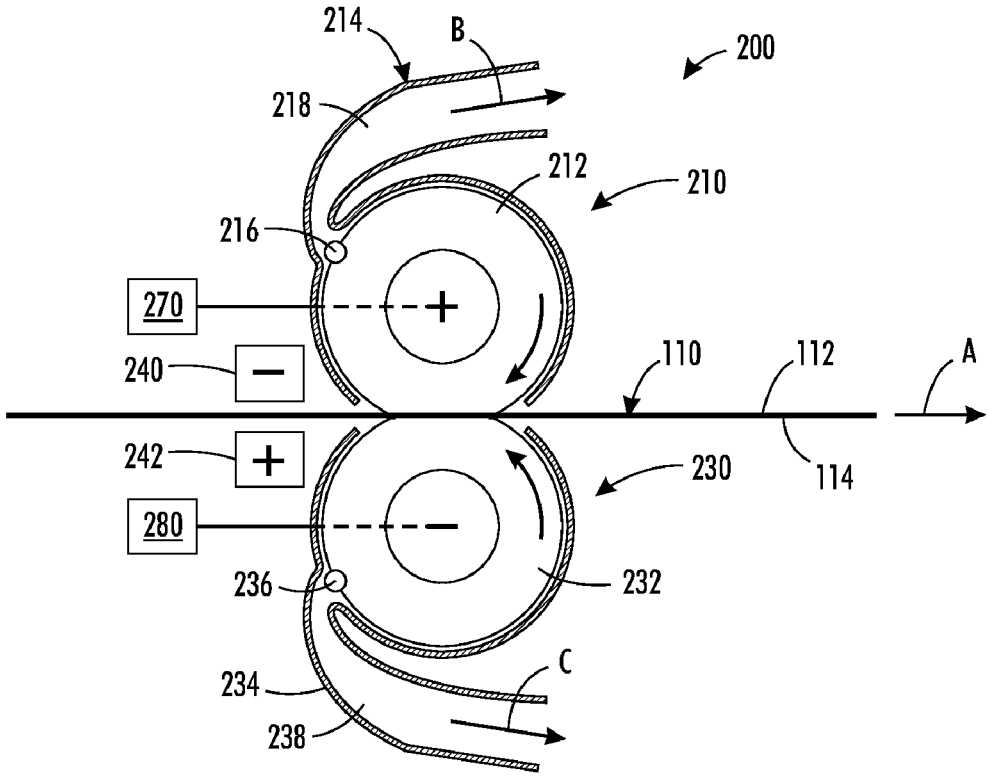
FIG. 2 depicts an exemplary embodiment of a web cleaning system useful for duplex printed webs.

FIG. 2 depicts an exemplary embodiment of the web cleaning system 200 that can be used to remove un-fixed toner from simplex and duplex printed webs. As shown, the web cleaning system 200 includes a first web cleaning device 210 for removing un-fixed toner from the top surface 112 of the web 110 and a second web cleaning device 230 for simultaneously removing un-fixed toner from the bottom surface 114 of the web 110.

The first web cleaning device 210 includes a first electrostatic cleaning brush 212 and the second web cleaning device 230 includes a second electrostatic cleaning brush 232. As shown, the first electrostatic cleaning brush 212 can be rotated clockwise and the second electrostatic cleaning brush 232 counter-clockwise to clean toner from the web 110 moving in the process direction A. In other embodiments of the web cleaning system 200, the first electrostatic cleaning brush 212 can be rotated counter-clockwise and the second electrostatic cleaning brush 232 clockwise to clean toner from the web moving in the process direction A. The first electrostatic cleaning brush 212 is biased to an opposite polarity from that of the second electrostatic cleaning brush 232. As shown, the first electrostatic cleaning brush 212 has a positive polarity and the second electrostatic cleaning brush 232 has a negative polarity. In other embodiments of the web cleaning system 200, the first electrostatic cleaning brush 212 can have a negative polarity and the second electrostatic cleaning brush 232 a positive polarity.

As shown, a first DC power supply 270 is connected to the first electrostatic cleaning brush 212 to apply a biasing voltage and a second DC power supply 280 is connected to the second electrostatic cleaning brush 232 to apply a biasing voltage. The first DC power supply 270 and the second DC power supply 280 can be operated in a constant voltage mode.

The first electrostatic cleaning brush 212 and the second electrostatic cleaning brush 232 comprise fibers that have low electrical conductivity. The fibers can have an electrical resistance of about $10^{12}$ to about $10^{15}$ Ω/cm. The fibers can comprise materials that are sufficiently-soft, and the first electrostatic cleaning brush 212 and second electrostatic cleaning brush 232 can be rotated at sufficiently-slow speeds, such that the fibers have only a very low impact on the first surface 112 and second surface 114 of the web 110. The first electrostatic cleaning brush 212 and the second electrostatic cleaning brush 232 can have small denier fibers, moderate weave density and small interference. The first electrostatic cleaning brush 212 and the second electrostatic cleaning brush 232 can each have the same construction and a cleaning capacity exceeding that typically needed to remove background levels of un-fixed toner from the web 110. For example, each of the first electrostatic cleaning brush 212 and the second electrostatic cleaning brush 232 can typically have a toner cleaning capacity of about 0.6 mg/cm$^2$ continuous input, while the printed web cleaning input can typically be about 0.002 mg/cm$^2$. The significant difference between the typical cleaning input and the typical electrostatic cleaning brush cleaning capacity for toner provides flexibility in the selection and operation of the first electrostatic cleaning brush 212 and the second electrostatic cleaning brush 232 in the web cleaning system 200.

As shown in FIG. 2, the first web cleaning device 210 further includes a first brush cleaning device 214 for removing toner from the first electrostatic cleaning brush 212. The first brush cleaning device 214 includes a first cleaning member 216 positioned in contact with the first electrostatic cleaning brush 212. The first cleaning member 216 can be, e.g., a rod or bar having any suitable cross-sectional shape. The first cleaning member 216 can be comprised of any suitable electrical conductor, such as bare metal. The first cleaning member 216 mechanically dislodges toner from the fibers of the rotating first electrostatic cleaning brush 212. This as-removed toner is transported away from the first electrostatic cleaning brush 212 through a flow passage 218 by an air flow moving in direction B. The air flow can be generated by a blower, or the like, in communication with the flow passage 218. The toner can then be collected using a filter, cyclone separator, or the like, arranged in flow communication with the flow passage 218.

The second web cleaning device 230 includes a second brush cleaning device 234 for removing toner from the second electrostatic cleaning brush 232. The second brush cleaning device 234 includes a second cleaning member 236 positioned to contact, and dislodge toner from, the second electrostatic cleaning brush 232. This as-removed toner is transported away from the second electrostatic cleaning brush 232 through a flow passage 238 by an air flow moving in direction C. The air flow can be generated by a blower, or the like, in communication with the flow passage 218. The toner can then be collected in the printing apparatus using a collection device, such as a particle filter, cyclone separator, or the like, in flow communication with the flow passage 238. The second brush cleaning device 214 can have the same construction as the first brush cleaning device 214.

As shown in FIG. 2, the web cleaning system 200 further includes a first charge device 240 positioned upstream from the first web cleaning device 210 and facing the first surface 112 of the web 110, and a second charge device 242 positioned upstream from the second web cleaning device 230 and facing the second surface 114 of the web 110. The first charge device 240 and the second charge device 242 are provided to charge the first surface 112 and the second surface 114, respectively, of the web 110, and toner carried on the first surface 112 and second surface 114, to an opposite polarity. As shown, the first charge device 240 has a negative polarity to charge the first surface 112 of the web 110 (and toner thereon) to a negative polarity, and the second charge device 242 has a positive polarity to charge the second surface 114 (and toner thereon) to a positive polarity. The first electrostatic cleaning brush 212 at a positive polarity cleans un-fixed, negative-charged toner from the first surface 112 of the web 110, while the second electrostatic cleaning brush 232 at a negative polarity cleans un-fixed, positive-charged toner from the second surface 114 of the web 110.

In other cases where the first electrostatic cleaning brush 212 has a negative polarity and the second electrostatic cleaning brush 232 has a positive polarity, the first charge device 240 has a positive polarity to charge the first surface 112 of the web 110 (and toner thereon) to a positive polarity, and the second charge device 242 has a negative polarity to charge the second surface 114 of the web 110 (and toner thereon) to a negative polarity to enhance toner removal from the web 110.

In embodiments, the first charge device 240 and the second charge device 242 can comprise, e.g., pin or wire corotrons or scorotrons and dicororotrons or discorotrons and bias charging rolls (BCRs). The first charge device 240 and the second charge device 242 can be operated in DC or AC modes, and can be operated in constant current or constant voltage mode. The coronodes (pins, wires or BCR) can be operated in DC or AC, or in AC plus a DC offset modes. The scorotron devices have a DC biased grid between the coronode and the web 110.

In some cases, the toner may have a charge remaining after the fixing operation that is sufficiently-high to allow the toner to be removed from the web 110 using the first electrostatic cleaning brush 212 and second electrostatic cleaning brush 232 without also using pre-clean charging of the web 110 using the first charge device 240 or the second charge device 242. The first charge device 240 and second charge device 242 may be omitted in such cases. In such cases, the bias of the first electrostatic cleaning brush 212 and/or second electrostatic cleaning brush 232 can be increased (as compared to the bias used when the first charge device 240 and second charge device 242 are also used) to enhance the toner cleaning efficiency. However, it is desirable to also use the first charge device 240 and the second charge device 242 to provide more robust cleaning of toner from the web 110 under all environmental conditions in the printing apparatus 100.

In the first electrostatic cleaning brush 212 and second electrostatic cleaning brush 232, the brush bias that is used is limited by the bias that creates electrical breakdown between the brush and the cleaning surface. When cleaning the web 110, which does not have a ground plane, the electric field for cleaning is established between the two polarities of the first electrostatic cleaning brush 212 and second electrostatic cleaning brush 232. For example, the first electrostatic cleaning brush 212 and second electrostatic cleaning brush 232 can be biased to a bias voltage of +150 volts and −150 volts, respectively, to provide a sufficient toner cleaning field.

In the first web cleaning device 210 and second web cleaning device 230, the air detoned first electrostatic cleaning brush 212 and second electrostatic cleaning brush 232 are continually vacuumed to prevent excessive toner accumulation on the brushes.

In other embodiments of the web cleaning system 200, each of the first electrostatic cleaning brush 212 and the second electrostatic cleaning brush 232 can have a length that does not exceed the width of the web 110. In these embodiments, the fibers of the first electrostatic cleaning brush 212 and second electrostatic cleaning brush 232 do not contact each. In these embodiments, the fibers of the first electrostatic cleaning brush 212 and second electrostatic cleaning brush 232 can comprise materials having high electrical conductivity, e.g., fibers having an electrical resistance of less than about $10^{12}$ Ω/cm. The current output of the first DC power supply 270 and second DC power supply 280 can be limited so that if, for example, the web 110 is torn, then the electrical short between the first electrostatic cleaning brush 212 and the second electrostatic cleaning brush 232 will not draw sufficient current to damage these brushes.

In these embodiments, the first charge device 240 and the second charge device 242 are non-contact-type devices, except for the BCR. The BCR comprises a circuit to limit current if the web 110 is torn and the two BCRs shorted to each other.

Figure 3:
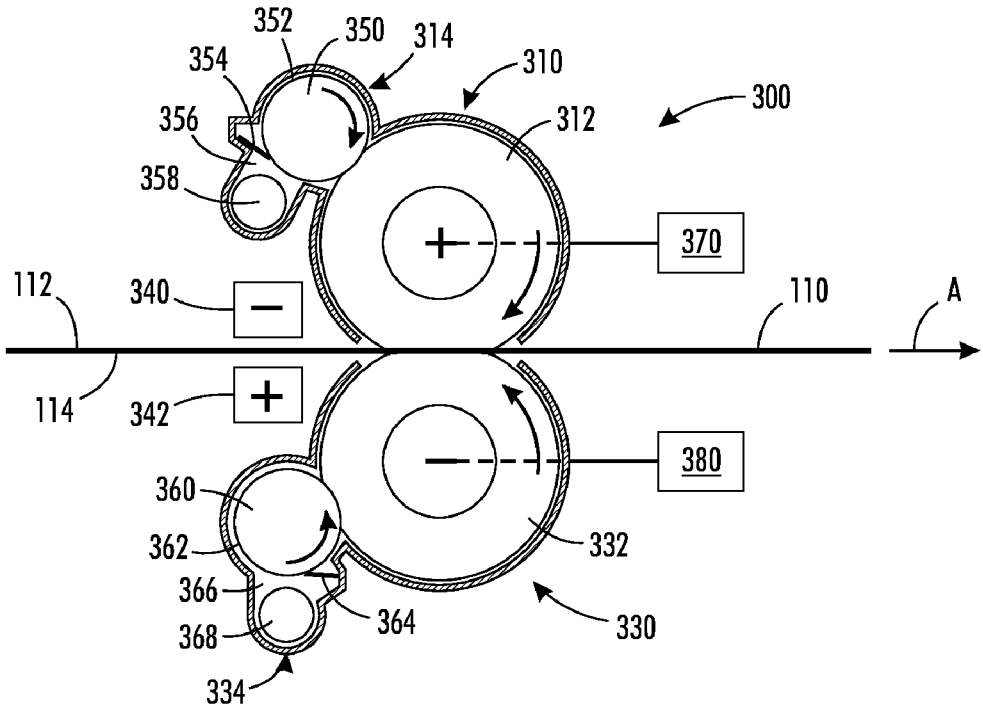
FIG. 3 depicts another exemplary embodiment of a web cleaning system useful for duplex printed webs.

FIG. 3 depicts a web cleaning system 300 according to another exemplary embodiment. The web cleaning system 300 can be used, e.g., in the printing apparatus 100 shown in FIG. 1 in place of the web cleaning system 200. As shown, the web cleaning system 300 includes a first web cleaning device 310 for removing un-fixed toner from the top surface 112 of the web 110 and a second web cleaning device 330 for simultaneously removing un-fixed toner from the bottom surface 114 of the web 110.

The first web cleaning device 310 includes a first electrostatic cleaning brush 312 and the second web cleaning device 330 includes a second electrostatic cleaning brush 332. A first DC power supply 370 is connected to the first electrostatic cleaning brush 312 to apply a biasing voltage and a second DC power supply 380 is connected to the second electrostatic cleaning brush 332 to apply a biasing voltage. The first electrostatic cleaning brush 312 and the second electrostatic cleaning brush 332 are of opposite polarity to each other. As shown, the first electrostatic cleaning brush 312 has a positive polarity and the second electrostatic cleaning brush 332 has a negative polarity. In other embodiments of the web cleaning system 300, the respective polarity of the first electrostatic cleaning brush 312 and the second electrostatic cleaning brush 332 can be reversed. As shown, the first electrostatic cleaning brush 312 can be rotated clockwise and the second electrostatic cleaning brush 332 counter-clockwise to clean the web 110 moving in the process direction A. In other embodiments, the first electrostatic cleaning brush 312 can be rotated counter-clockwise and the second electrostatic cleaning brush 332 clockwise to clean toner from the web 110 moving in the process direction A.

The first electrostatic cleaning brush 312 and the second electrostatic cleaning brush 332 can have the same configuration and toner cleaning capacity as the first electrostatic cleaning brush 212 and the second electrostatic cleaning brush 232, respectively, of the web cleaning system 200, for example.

As shown in FIG. 3, the first web cleaning device 310 further includes a first brush cleaning device 314. The first brush cleaning device 314 includes a rotatable first cleaning roll 350 having an outer surface 352 contacting the first electrostatic cleaning brush 312. The outer surface 352 can be comprised of any suitable electrical conductor, such as bare metal. The outer surface 352 can be biased to a higher positive bias voltage than that of the first electrostatic cleaning brush 312 to remove toner from the fibers of the first electrostatic cleaning brush 312. This toner is removed from the outer surface 352 by a cleaning blade 354 and collected in a sump 356. A rotatable auger 358 is provided to transport the collected toner away from the sump 356.

The second web cleaning device 330 includes a second brush cleaning device 334. The second brush cleaning device 334 can have the same construction as the first brush cleaning device 314, for example. The second brush cleaning device 334 includes a rotatable second cleaning roll 360 having an outer surface 362 contacting the second electrostatic cleaning brush 332. The outer surface 362 can be comprised of any electrical conductor, such as bare metal, and can be biased to a higher negative bias voltage than the second electrostatic cleaning brush 332 to remove toner from the fibers of the second electrostatic cleaning brush 332. This removed toner is dislodged from the outer surface 362 by a cleaning blade 364, collected in a sump 366, and transported away from the sump 366 by a rotatable auger 368.

As shown in FIG. 3, the web cleaning system 300 further includes a first charge device 340 positioned upstream from the first web cleaning device 310 and facing the first surface 112 of the web 110, and a second charge device 342 positioned upstream from the second web cleaning device 330 and facing the second surface 114 of the web 110. The first charge device 340 and the second charge device 342 are of opposite polarity to each other. As shown, the first charge device 340 has a negative polarity to charge the first surface 112 of the web 110 (and toner thereon) to a negative polarity, and the second charge device 342 has a positive polarity to charge the second surface 114 (and toner thereon) to a positive polarity. The first electrostatic cleaning brush 312 at a positive polarity cleans un-fixed, negative-charged toner from the first surface 112 of the web 110, while the second electrostatic cleaning brush 332 at a negative polarity cleans un-fixed, positive-charged toner from the second surface 114 of the web 110.

In other cases where the first electrostatic cleaning brush 312 has a negative polarity and the second electrostatic cleaning brush 332 has a positive polarity, the first charge device 340 has a positive polarity to charge the first surface 112 of the web 110 (and toner thereon) to a positive polarity and the second charge device 342 has a negative polarity to charge the second surface 114 of the web 110 (and toner thereon) to a negative polarity to provide robust toner removal.

The first charging device 340 and the second charging device 342 may be omitted in cases where the toner has a charge remaining after the fixing operation that is sufficiently-high to allow the toner to be removed from the web 110 using the first electrostatic cleaning brush 312 and second electrostatic cleaning brush 332 without using pre-clean charging of the web 110 with the first charge device 340 or the second charge device 342.

Electrostatic detoning, as used in the web cleaning system 300, is desirable for removing toner from duplex printed webs because of the typical low toner input levels to the web cleaning system 300 for a duplex printed web 110. The typical background densities of toner input are suitable for the use of electrostatic detoning because toner typically only accumulates at the very tips of the brush fibers. In cases where higher than desirable densities of toner input are cleaned with the first electrostatic cleaning brush 312 and second electrostatic cleaning brush 332, some of the toner may attach to the brush fibers further down from the tip. This toner may eventually advance down the full length of the fibers and start a build up of toner at the core outward. To avoid excessive toner accumulation in the first electrostatic cleaning brush 312 or the second electrostatic cleaning brush 332, these brushes can be periodically vacuumed to remove excessive built-up toner, or replaced.

In other embodiments of the web cleaning system 300, each of the first electrostatic cleaning brush 312 and the second electrostatic cleaning brush 332 can have a length that does not exceed the width of the web 110, so that the fibers of the first electrostatic cleaning brush 312 and second electrostatic cleaning brush 332 do not contact each other during normal operation. In these embodiments, the fibers of the first electrostatic cleaning brush 312 and second electrostatic cleaning brush 332 can have high electrical conductivity, e.g., an electrical resistance of less than about $10^{12}$ Ω/cm. The current output of the first DC power supply 370 and the second DC power supply 380 can be current limited to protect against damage to the first electrostatic cleaning brush 312 and second electrostatic cleaning brush 332 if the web 110 is torn. In these embodiments, the first charge device 340 and second charge device 342 can also be protected from damage if the web 110 is torn.

In these embodiments of the web cleaning system 300, the outer surface 352 of the first cleaning roll 350 and the outer surface 362 of the outer surface 362 of the second cleaning roll 360 can be comprised of any suitable dielectric material, such as anodized aluminum, ceramic materials, or the like. The dielectric material can have an electrical conductivity of less than about $10^{-8}$ (Ω-cm)$^{-1}$.

Electrostatic detoning can provide the advantage of low cost, lower energy consumption and small size for the complete system.

Figure 4:
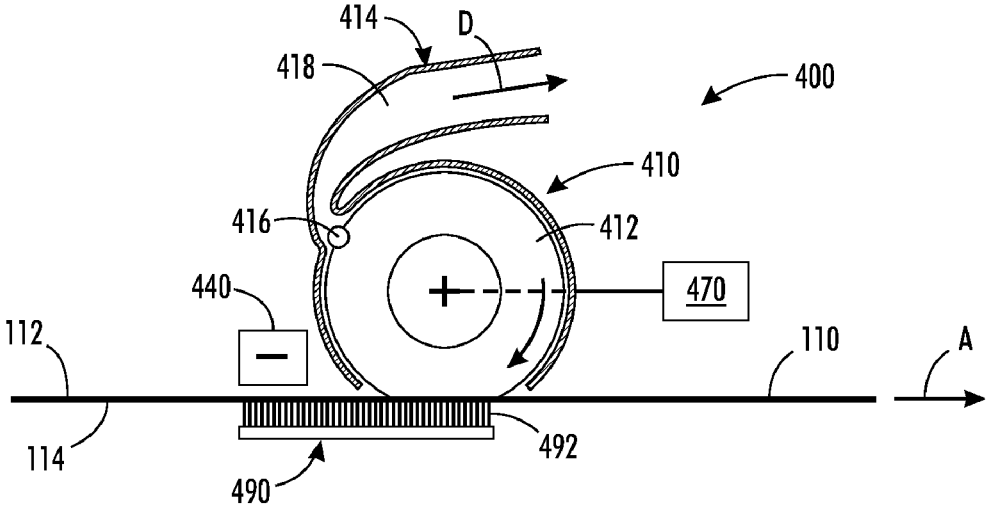
FIG. 4 depicts an exemplary embodiment of a web cleaning system useful for simplex printed webs.

FIG. 4 depicts an exemplary embodiment of a web cleaning system 400 that can be used to remove un-fixed toner from simplex printed webs. The web cleaning system 400 can be used, e.g., in the printing apparatus 100 shown in FIG. 1 in place of the web cleaning system 200.

As shown, the web cleaning system 400 includes a single web cleaning device 410 with an electrostatic cleaning brush 412. A DC power supply 470 is connected to the electrostatic cleaning brush 412 to apply a biasing voltage. The electrostatic cleaning brush 412 can have the same construction as the first electrostatic cleaning brush 212 of the web cleaning system 200, for example. The electrostatic cleaning brush 412 has a positive polarity. In other embodiments of the web cleaning system 400, the electrostatic cleaning brush 412 can have a negative polarity. As shown, the electrostatic cleaning brush 412 can be rotated clockwise to clean the web 110 moving in the process direction A. In other embodiments, the electrostatic cleaning brush 412 can be rotated counter-clockwise to clean toner from the web 110 moving in the process direction A. The electrostatic cleaning brush 412 has a very low impact on the first surface 112 of the web 110.

The electrostatic cleaning brush 412 comprises fibers having low electrical conductivity, such as having a resistance of about $10^{12}$ to about $10^{15}$ Ω/cm.

As shown in FIG. 4, the web cleaning device 410 further includes a brush cleaning device 414. The brush cleaning device 414 can have the same construction as the first brush cleaning device 214 of the web cleaning system 200, for example. The brush cleaning device 414 includes a cleaning member 416 positioned in contact with the electrostatic cleaning brush 412. The cleaning member 416 mechanically dislodges toner from the fibers of the rotating electrostatic cleaning brush 412. This removed toner is transported away from the electrostatic cleaning brush 412 by an air flow through a flow passage 418 as indicated by arrow D. The toner can then be collected using a filter, cyclone separator, or the like, arranged in flow communication with the flow passage 418.

The web cleaning device 410 includes a charge device 440 positioned upstream from the web cleaning device 410 and facing the first surface 112 of the web 110. The charge device 440 charges the first surface 112 of the web 110, and toner carried on the first surface 112, to a negative polarity. The electrostatic cleaning brush 412, which has a positive polarity, cleans un-fixed, negative-charged toner from the first surface 112 of the web 110.

In other cases, the polarity of the electrostatic cleaning brush 412 and the charge device 440 can be reversed to charge the first surface 112 of the web 110 (and toner thereon) to a positive polarity.

The web cleaning system 400 further includes an electrically-conductive, grounded conductor 490. In the illustrated embodiment, the conductor 490 comprises conductive fibers 492 contacting the second surface 114 of the web 110 to provide a reference ground for the charge device 440 and the electrostatic cleaning brush 412, without damage to the second surface 114 of the moving web 110. In other embodiments of the web cleaning system 400, the conductor 490 can comprise a conductive sheet backed by a foam pad or a conductive plate.

Figure 5:
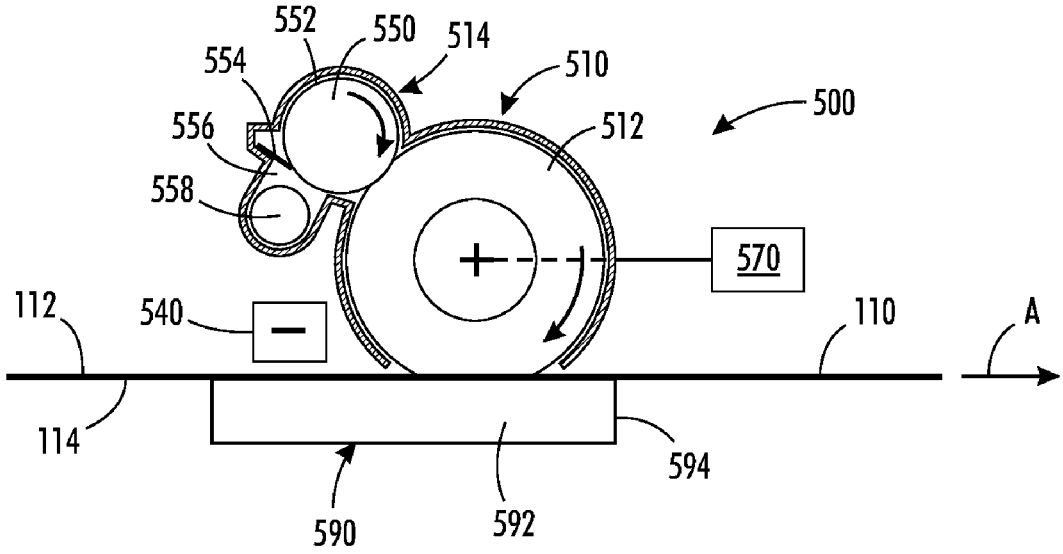
FIG. 5 depicts another exemplary embodiment of a web cleaning system useful for simplex printed webs.

FIG. 5 depicts a web cleaning system 400 according to another exemplary embodiment. The web cleaning system 500 can be used to remove un-fixed toner from simplex printed webs. The web cleaning system 500 can be used, e.g., in the printing apparatus 100 shown in FIG. 1 in place of the web cleaning system 200.

The web cleaning system 500 includes a single web cleaning device 510 with an electrostatic cleaning brush 512. A DC power supply 570 is connected to the electrostatic cleaning brush 512 to apply a biasing voltage. The electrostatic cleaning brush 512 can have the same construction as, e.g., the electrostatic cleaning brush 412 of the web cleaning system 400. The electrostatic cleaning brush 512 has a positive polarity. In other embodiments of the web cleaning system 500, the electrostatic cleaning brush 512 can have a negative polarity. As shown, the electrostatic cleaning brush 512 can be rotated clockwise to clean the web 110 moving in the process direction A. In other embodiments, the electrostatic cleaning brush 512 can be rotated counter-clockwise to clean toner from the web 110 moving in the process direction A.

The electrostatic cleaning brush 512 comprises fibers having high electrical conductivity, such as an electrical resistance of less than about $10^{12}$ Ω/cm. The electrostatic cleaning brush 512 has a very low impact on the first surface 112 of the web 110.

As shown in FIG. 5, the web cleaning device 510 further includes a brush cleaning device 514. The brush cleaning device 514 can have the same construction as the first brush cleaning device 314 of the web cleaning system 300, for example. The brush cleaning device 514 includes a rotatable cleaning roll 550 having an outer surface 552 contacting the electrostatic cleaning brush 512. The outer surface 552 can be comprised of any suitable dielectric material, such as anodized aluminum, a ceramic material coating, or the like. The dielectric material can have an electrical conductivity of less than about $10^{-8}$ $(\Omega\text{-cm})^{-1}$. The outer surface 552 can be biased to a higher positive bias voltage than that of the electrostatic cleaning brush 512 to remove toner from the brush fibers. This toner is removed from the outer surface 552 by a cleaning blade 554 and collected in a sump 556. A rotatable auger 558 transports the collected toner away from the sump 556.

The web cleaning device 510 includes a charge device 540 positioned upstream from the web cleaning device 510 and facing the first surface 112 of the web 110. The charge device 540 charges the first surface 112 of the web 110, and toner carried on the first surface 112, to a negative polarity. The electrostatic cleaning brush 512, which has a positive polarity, cleans un-fixed, negative-charged toner from the first surface 112 of the web 110.

In other cases, the polarity of the electrostatic cleaning brush 512 and the charge device 540 can be reversed to charge the first surface 112 of the web 110 (and toner thereon) to a positive polarity.

The web cleaning system 500 further includes a grounded, conductive member 590 having an outer coating 592 of a dielectric material, which contacts the second surface 114 of the web 110. The dielectric material can have an electrical conductivity of less than about $10^{-8}$ $(\Omega\text{-cm})^{-1}$. The conductive member 590 can comprise an anodized aluminum plate, a metallic plate coated with a ceramic coating having controlled electrical conductivity, or the like. The outer coating 592 provides a small amount of conductivity so that charges can be conducted to ground and do not build up on the outer coating 592.

Figure 6:
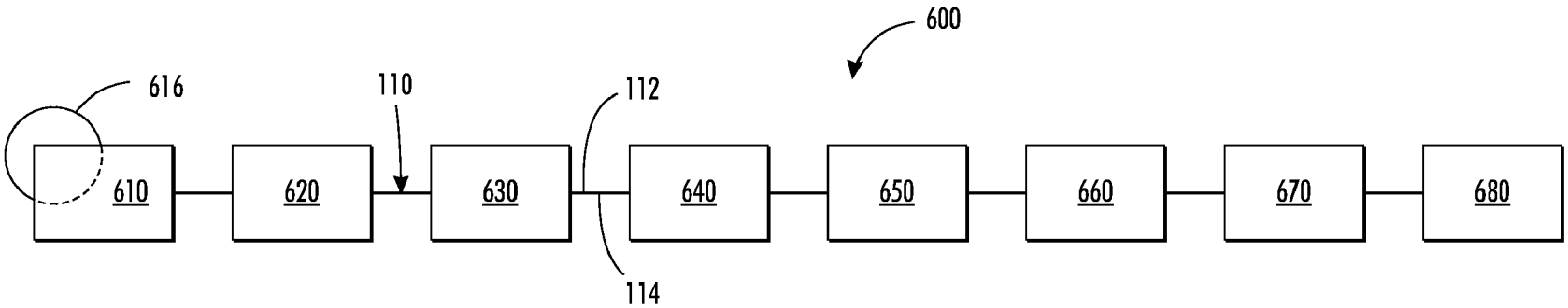
FIG. 6 depicts an exemplary embodiment of an apparatus including two web cleaning systems arranged in series useful in cleaning duplex printed webs.

In further embodiments, more than one web cleaning system can be used to remove unfixed toner from a web. FIG. 6 depicts an exemplary embodiment of an apparatus 600 including dual web cleaning systems for removing toner from a duplex printed web 110 having a first surface 112 and a second surface 114. As shown, the apparatus 600 includes an unwinding device 610 that feeds the web 110 from a roll 616. The web 110 can be comprised of plain paper, or the like. A web cleaning device 620 cleans paper dust, chads, and other debris from the web 110 before it enters a first printing apparatus 630. The web cleaning device 620 may not include an electrostatic cleaning brush, but can include mechanical brushes. The first printing apparatus 630 includes a marking device and a fixing device. The first printing apparatus 630 applied toner on the first surface 112 of the web 110 and fixes the toner with heat and optionally also pressure. Optionally, a dryer may be provided between the web cleaner 620 and the first printing apparatus 630. After the web 110 passes through the first printing apparatus 630 with toner fixed on the first surface 112, the web 110 enters a first web cleaning system 640, which includes at least one electrostatic cleaning brush. The first web cleaning system 640 cleans un-fixed toner from the first surface 112 of the web 110. The web 110 then passes through a turnbar 650, which turns the web 110 over to allow it to be printed on the second surface 114 in a second printing apparatus 660. The second printing apparatus 660, which includes a marking device and a fixing device, applies toner to the second surface 114 of the web 110 and fixes the toner. The second surface 114 is then cleaned by a second web cleaning system 670, which also includes at least one electrostatic cleaning brush, to remove un-fixed toner.

The web 110 then enters one or more finishing devices 680. The printed web can be rewound onto a roll using a rewinding device. A cutter/stacker can be used to cut the printed webs into sheets and to stack them. The cutter/stacker can typically be preceded by a buffer that temporarily stores some of the web to allow the cutter/stacker to stop for delivering a completed stack of pages. The cutter/stacker then operates at a higher speed until the web stored in the buffer is drawn out of the buffer. Once the cutter/stacker has caught up to the rest of the process that continues to operate at a constant speed, the cutter/stacker returns to normal speed.

In the apparatus 600, each of the first web cleaning system 640 and the second web cleaning system 670 can comprise one of the web cleaning systems 200, 300, 400 or 500 to clean un-fixed toner from the web 110.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A web cleaning system, comprising:

a first web cleaning device comprising:

a rotatable first electrostatic cleaning brush for contacting a first surface of a moving web on which toner is disposed to remove un-fixed toner from the first surface; and a first brush cleaning device including a first cleaning member, the first cleaning member being fixedly arranged to contact the first electrostatic cleaning brush for removing toner from the first electrostatic cleaning brush.

2. The web cleaning system of claim 1, wherein:

the first cleaning member comprises a first cleaning bar contacting the first electrostatic cleaning brush for mechanically dislodging toner from the first electrostatic cleaning brush; and the first brush cleaning device further comprises a first flow passage through which a first air flow is generated to transport dislodged toner away from the first electrostatic cleaning brush.

3. The web cleaning system of claim 1, further comprising:

a first charge device disposed upstream of the first web cleaning device and facing the first surface of the web; and a grounded backer member contacting the second surface of the web;

wherein the first electrostatic cleaning brush has a positive polarity or a negative polarity and the first charge device is operable to charge the first surface of the web and toner thereon to a polarity opposite to that of the first electrostatic cleaning brush.

4. The web cleaning system of claim 1, further comprising a second web cleaning device comprising:

a rotatable second electrostatic cleaning brush for contacting a second surface of the moving web on which toner is disposed, and which is opposite to the first surface, to remove unfixed toner from the second surface; and a second brush cleaning device including a second cleaning member contacting the second electrostatic cleaning brush for removing toner from the second electrostatic cleaning brush.

5. The web cleaning system of claim 4, further comprising:

a first charge device disposed upstream of the first web cleaning device and facing the first surface of the web; and a second charge device disposed upstream of the second web cleaning device and facing the second surface of the web;

wherein the first electrostatic cleaning brush has a positive polarity or a negative polarity and the first charge device is operable to charge the first surface of the web and toner thereon to a polarity opposite to that of the first electrostatic cleaning brush; and wherein the second electrostatic cleaning brush has a polarity opposite to that of the first electrostatic cleaning brush and the second charge device is operable to charge the second surface of the web and toner thereon to a polarity opposite to that of the second electrostatic cleaning brush.

6. The web cleaning system of claim 4, wherein:

the first cleaning member comprises a first cleaning bar contacting the first electrostatic cleaning brush for mechanically dislodging toner from the first electrostatic cleaning brush;

the first brush cleaning device further comprises a first flow passage through which a first air flow is generated to transport dislodged toner away from the first electrostatic cleaning brush;

the second cleaning member comprises a second cleaning bar contacting the second electrostatic cleaning brush for mechanically dislodging toner from the second electrostatic cleaning brush; and the second brush cleaning device further comprises a second flow passage through which a second air flow is generated to transport dislodged toner away from the second electrostatic cleaning brush.

7. An apparatus useful in printing onto a web, comprising:

a first marking device for applying toner onto a first surface of a web;

a first fixing device for fixing the toner to the first surface of the web; and a first web cleaning system downstream from the first fixing device, the first web cleaning system comprising a first web cleaning device including:

a rotatable first electrostatic cleaning brush for contacting the first surface of the web moving in the apparatus to remove un-fixed toner from the first surface; and a first brush cleaning device including a first cleaning member, the first cleaning member being fixedly arranged to contact the first electrostatic cleaning brush for removing toner from the first electrostatic cleaning brush.

8. The apparatus of claim 7, further comprising:

a first charge device disposed upstream of the first web cleaning device and facing the first surface of the web; and a first grounded backer member contacting the second surface of the web;

wherein the first electrostatic cleaning brush has a positive polarity or a negative polarity and the first charge device is operable to charge the first surface of the web and toner thereon to a polarity opposite to that of the first electrostatic cleaning brush.

9. An apparatus useful in printing onto a web, comprising:

a first marking device for applying toner onto a first surface of a web;

a first fixing device for fixing the toner to the first surface of the web; and a first web cleaning system downstream from the first fixing device, the first web cleaning system comprising a first web cleaning device including:

a rotatable first electrostatic cleaning brush for contacting the first surface of the web moving in the apparatus to remove un-fixed toner from the first surface;

a first brush cleaning device including a first cleaning member contacting the first electrostatic cleaning brush for removing toner from the first electrostatic cleaning brush a turning device disposed downstream from the first web cleaning system for turning over the web;

a second marking device downstream from the turning device for applying toner onto a second surface of the web opposite to the first surface;

a second fixing device for fixing the applied toner to the second surface of the web; and a second web cleaning system downstream from the second fixing device, the second web cleaning system comprising a second web cleaning device including:

a rotatable second electrostatic cleaning brush for contacting the second surface of the moving web to remove un-fixed toner from the second surface; and a second brush cleaning device including a second cleaning member contacting the second first electrostatic cleaning brush for removing toner from the second electrostatic cleaning brush.

10. The apparatus of claim 9, wherein:

the first web cleaning system comprises first charge device disposed upstream of the first cleaning device and facing the first surface of the web; and the second web cleaning device comprises a second charge device disposed upstream of the second cleaning device and facing the second surface of the web;

wherein the first electrostatic cleaning brush has a positive polarity or a negative polarity and the first charge device is operable to charge the first surface of the web and toner thereon to a polarity opposite to that of the first electrostatic cleaning brush; and wherein the second electrostatic cleaning brush has a positive polarity or a negative polarity and the second charge device is operable to charge the second surface of the web and toner thereon to a polarity opposite to that of the second electrostatic cleaning brush.

11. The apparatus of claim 10, wherein:

the first web cleaning system further comprises a first grounded backer member contacting the second surface of the web; and the second web cleaning system further comprises a second grounded backer member contacting the first surface of the web.

12. The apparatus of claim 9, wherein:

the first web cleaning system further comprises a third web cleaning device including:

a rotatable third electrostatic cleaning brush for contacting the second surface of the moving web to remove un-fixed toner from the second surface; and the second web cleaning system further comprises a fourth web cleaning device including:

a rotatable fourth electrostatic cleaning brush for contacting the first surface of the moving web to remove un-fixed toner from the first surface.

13. The apparatus of claim 12, further comprising:

a first charge device disposed upstream of the first web cleaning device and facing the first surface of the web; and a second charge device disposed upstream of the third web cleaning device and facing the second surface of the web;

a third charge device disposed upstream of the second web cleaning device and facing the second surface of the web; and a fourth charge device disposed upstream of the fourth web cleaning device and facing the first surface of the web;

wherein the first electrostatic cleaning brush has a positive polarity or a negative polarity and the first charge device is operable to charge the first surface of the web and toner thereon to a polarity opposite to that of the first electrostatic cleaning brush;

wherein the third electrostatic cleaning brush has a polarity opposite to that of the first electrostatic cleaning brush and the second charge device is operable to charge the second surface of the web and toner thereon to a polarity opposite to that of the third electrostatic cleaning brush;

wherein the second electrostatic cleaning brush has a positive polarity or a negative polarity and the third charge device is operable to charge the second surface of the web and toner thereon to a polarity opposite to that of the second electrostatic cleaning brush; and wherein the fourth electrostatic cleaning brush has a polarity opposite to that of the second electrostatic cleaning brush and the fourth charge device is operable to charge the first surface of the web and toner thereon to a polarity opposite to that of the fourth electrostatic cleaning brush.

14. A method of cleaning a printed web, comprising:

contacting a first surface of a moving web on which toner is disposed with a rotating first electrostatic cleaning brush of a first web cleaning device to remove un-fixed toner from the first surface; and contacting the first electrostatic cleaning brush with a first cleaning member of a first brush cleaning device to remove toner from the first electrostatic cleaning brush, the first cleaning member being fixedly arranged.

15. The method of claim 14, wherein:

the first cleaning member comprises a first cleaning bar which contacts the first electrostatic cleaning brush and mechanically dislodges toner from the first electrostatic cleaning brush; and the first brush cleaning device further comprises a first flow passage through which a first air flow is generated to transport dislodged toner away from the first electrostatic cleaning brush.

16. The method of claim 14, wherein:

the first cleaning member comprises a rotatable first cleaning roll including a first outer surface contacting the first electrostatic cleaning brush, the first cleaning roll removes toner from the first electrostatic cleaning brush onto the first surface; and the first brush cleaning device further comprises:

a first cleaning blade which removes toner from the first outer surface of the first cleaning roll;

a first sump in which toner removed from the first surface is collected; and a first auger which transports toner away from the first sump.

17. The method of claim 14, further comprising:

charging the first surface of the web and toner thereon with a first charge device disposed upstream of the first web cleaning device and facing the first surface of the web; and contacting a second surface of the web opposite to the first surface with a grounded backer member;

wherein the first electrostatic cleaning brush has a positive polarity or a negative polarity and the first charge device charges the first surface of the web and toner thereon to a polarity opposite to that of the first electrostatic cleaning brush.

18. The method of claim 14, further comprising:

contacting a second surface of the moving web on which toner is disposed with a rotating second electrostatic cleaning brush of a second web cleaning device to remove un-fixed toner from the second surface, the second surface being opposite to the first surface; and contacting the second electrostatic cleaning brush with a second cleaning member of a second brush cleaning device to remove toner from the second electrostatic cleaning brush.

19. The method of claim 18, further comprising:

charging the first surface of the web and toner thereon with a first charge device disposed upstream of the first web cleaning device and facing the first surface of the web; and charging the second surface of the web and toner thereon with a second charge device disposed upstream of the second web cleaning device and facing the second surface of the web;

wherein the first electrostatic cleaning brush has a positive polarity or a negative polarity and the first charge device charges the first surface of the web and toner thereon to a polarity opposite to that of the first electrostatic cleaning brush; and wherein the second electrostatic cleaning brush has a polarity opposite to that of the first electrostatic cleaning brush and the second charge device charges the second surface of the web and toner thereon to a polarity opposite to that of the second electrostatic cleaning brush.

* * * * *